US008813852B2

(12) United States Patent
Thomson

(10) Patent No.: US 8,813,852 B2
(45) Date of Patent: Aug. 26, 2014

(54) WELLHEAD ANNULUS MONITORING

(75) Inventor: George S. Thomson, Stonehaven (GB)

(73) Assignee: Aker Subsea Limited, Maidenhead, Berkshire (GB)

( * ) Notice: Subject to any disclaimer, the term of this patent is extended or adjusted under 35 U.S.C. 154(b) by 377 days.

(21) Appl. No.: 13/059,121

(22) PCT Filed: Jul. 15, 2009

(86) PCT No.: PCT/GB2009/001783

§ 371 (c)(1),
(2), (4) Date: Feb. 15, 2011

(87) PCT Pub. No.: WO2010/020742

PCT Pub. Date: Feb. 25, 2010

(65) Prior Publication Data

US 2011/0147001 A1 Jun. 23, 2011

(51) Int. Cl.

| | |
|---|---|
| ***E21B 23/00*** | (2006.01) |
| ***E21B 33/035*** | (2006.01) |
| ***E21B 33/043*** | (2006.01) |
| ***E21B 33/047*** | (2006.01) |

(52) U.S. Cl.

CPC ..... *E21B 33/043* (2013.01); *E21B 33/047* (2013.01)

USPC ..... 166/348; 166/368; 166/350; 166/382; 166/88.1

(58) Field of Classification Search

CPC ..... E21B 33/043; E21B 33/047

USPC ..... 166/368, 88.1, 382, 378, 336, 348, 350, 166/351, 387

See application file for complete search history.

(56) References Cited

U.S. PATENT DOCUMENTS

| | | | | |
|---|---|---|---|---|
| 5,366,017 | A | 11/1994 | Voss, Jr. | |
| 5,372,201 | A | 12/1994 | Milberger | |
| 5,503,230 | A * | 4/1996 | Osborne et al. | 166/344 |
| 6,062,314 | A | 5/2000 | Nobileau | |
| 6,675,900 | B2 * | 1/2004 | Baskett et al. | 166/379 |
| 2003/0121667 | A1 * | 7/2003 | Massie et al. | 166/344 |
| 2003/0127229 | A1 | 7/2003 | Buckle et al. | |
| 2005/0121199 | A1 | 6/2005 | Massie et al. | |

FOREIGN PATENT DOCUMENTS

| | | |
|---|---|---|
| GB | 2 364 538 | 1/2002 |
| GB | 2 376 485 | 12/2002 |
| GB | 2 377 954 | 1/2003 |
| GB | 2 395 736 | 8/2005 |
| GB | 2 422 161 | 7/2006 |

OTHER PUBLICATIONS

International Search Report for PCT/GB2009/001783, mailed Nov. 25, 2009.

* cited by examiner

*Primary Examiner* — James Sayre
(74) *Attorney, Agent, or Firm* — Nixon & Vanderhye PC

(57) ABSTRACT

A subsea wellhead assembly includes a production casing hanger defining a series of passageways from an annulus between a production casing string and an outer casing to a region that can communicate, for example, by way of an isolation sleeve, with a production tree. The passageways extend to the interior of the casing hanger. A positionally adjustable sleeve fits within the casing hanger and carries exterior seals that are disposed so that for a first position of the adjustable sleeve within the casing hanger, fluid passage through the series of passageways is blocked, and for a second position of the sleeve within the casing hanger, the fluid passage is allowed. The adjustable sleeve can be operated by a simple tool through the production tree.

16 Claims, 1 Drawing Sheet

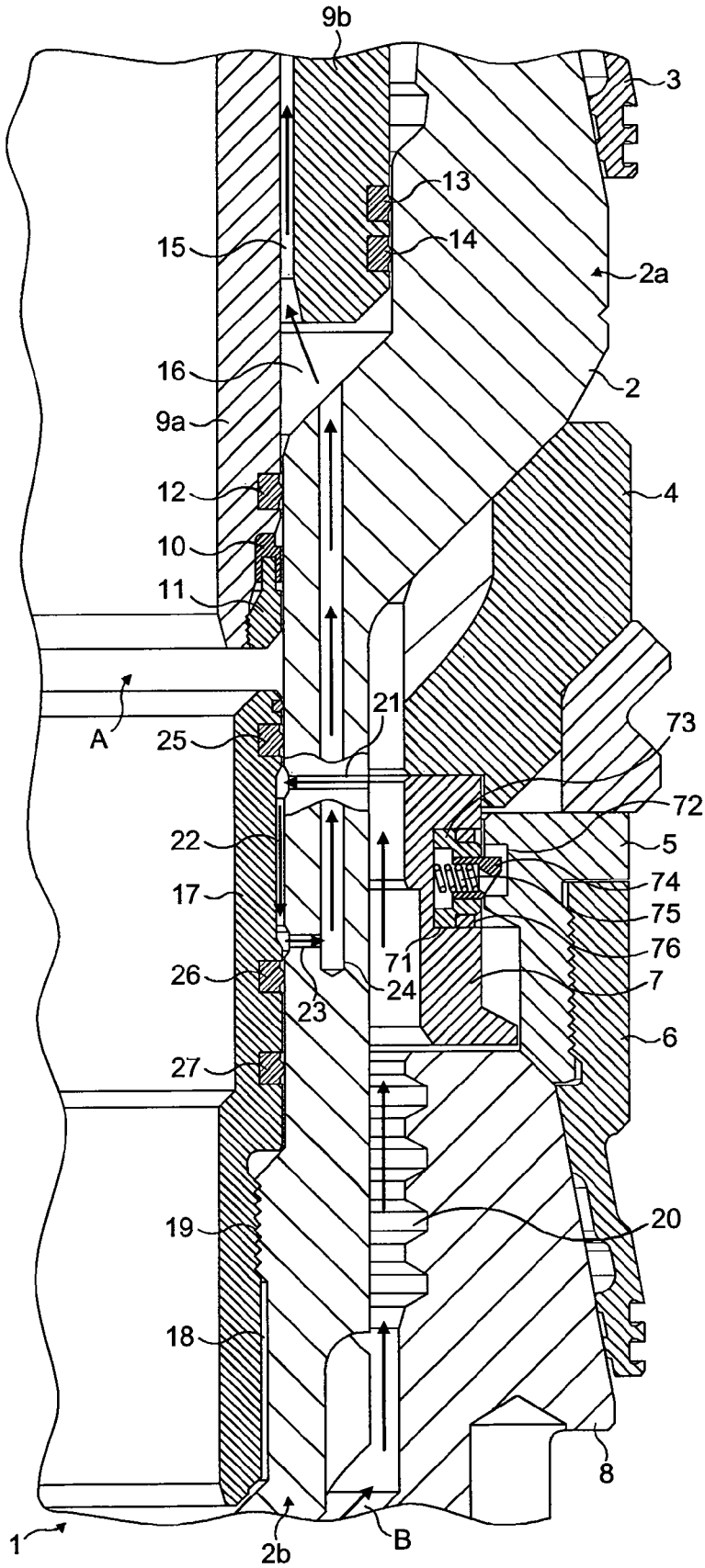
9b
3
13
14
15
2a
16
2
9a
12
4
10
11
A
25
21
73
72
22
5
74
17
75
76
71
26
24
7
23
6
27
19
20
18
8
1
2b
B

WELLHEAD ANNULUS MONITORING

This application is the U.S. national phase of International Application No. PCT/GB2009/001783, filed 15 Jul. 2009, which designated the U.S. and claims priority to GB Application No. 0815035.1 filed 16 Aug. 2008, the entire contents of each of which are hereby incorporated by reference.

BACKGROUND

1. Technical Field

This invention relates to subsea well heads and particularly to the monitoring of pressure in the region between a production casing string and a relatively outer casing.

2. Related Art

Subsea wellheads support a multiplicity of casing strings which extend down into a well. These casing strings include a production casing string and a relatively outer casing string. These strings are usually within a larger casing known as the outer conductor. The annular region between the production string and the relatively outer string is usually called the B annulus. It is desirable to monitor the pressure in the B annulus and preferable for the monitoring to be performed by means of an associated production tree, i.e. a Xmas tree.

There exists a variety of designs such as those described in the documents GB-2376485-A and GB-2395736-A for this general purpose. These and other existing designs are however quite complex. In particular they include penetrations of the wellhead housing and conduits either through this housing or external thereto to a region above any casing hanger. There exists a need for a simpler yet reliable design.

It is known (for example from U.S. Pat. No. 5,366,017) to provide communication from the B annulus to the tree by way of a passage through a production casing hanger. However, the passage needs blocking during the stages of drilling and the installation of the casing hanger and it is the object of the present invention to provide an assembly which allows the selective closure and opening of the passage by means of an easily operated sealing adaptor.

BRIEF SUMMARY

In a preferred embodiment, a subsea wellhead assembly includes a production casing hanger defining a series of passageways from an annulus between a production casing string and a relatively outer casing to a region communicable with a production tree, the passageways extending to the interior of the casing hanger. A positionally adjustable sleeve fits within the casing hanger and carries exterior seals which are disposed so that for a first to position of the sleeve within the casing hanger fluid passage through the series of passageways is blocked and for a second position of the sleeve within the casing hanger said fluid passage is allowed.

The positionally adjustable sleeve may make a screw threaded engagement with the casing hanger such that movement of the sleeve between the two positions can be effected by rotation of the sleeve.

The passageways through the casing hanger may include two passageways which communicate with the interior of the casing hanger in spaced apart locations. One of these passageway may extend radially through the casing hanger from the outside to the inside thereof and the other may extend radially from the inside of the casing hanger partly through the casing hanger and may lead to a vertical passageway extending upwardly through the body of the casing hanger to the region which can communicate with the production tree.

The seals may include two spaced apart seals which, in the first position of the sleeve, are disposed one above and one below one of the two passageways. The seals may include a third seal, the third seal and at least one of said two seals sealing a space embracing said locations from above and below.

The assembly may include an isolation sleeve which provides communication between said region and the production tree, and in particular by way of an upward passageway from the region.

The exemplary embodiment also provides a production casing hanger for a subsea well including an upper cylindrical part and a lower cylindrical part of lesser internal diameter than the upper cylindrical part, in which a first passageway extends radially through the lower part of the casing hanger from the outside to the inside thereof and a second passageway extends radially from the inside of the casing hanger partly through the casing hanger, and in which a passageway extends upwardly from the second passageway through the lower part of the casing hanger to a region within the upper part of the casing hanger, the casing hanger being adapted to receive an internal sleeve which is positionally adjustable to allow and prevent fluid flow through the upward passage to the region.

One embodiment of the invention is now described by way of example with reference to the drawing.

BRIEF DESCRIPTION OF THE DRAWING

The single FIG. 1 illustrates the relevant parts of a wellhead assembly including a casing hanger and an adaptor according to an exemplary embodiment of the invention.

DETAILED DESCRIPTION OF EXEMPLARY EMBODIMENTS

The assembly 1 shown in FIG. 1 includes a production casing hanger 2 which has an upper larger diameter part 2*a* and a lower lesser diameter cylindrical part 2*b* which extends downwardly. 'Upwardly' and 'downwardly' herein refer to the normal disposition of the assembly in use. Outside the casing hanger part 2*a* is an upper pack-off seal 3 disposed between the casing hanger 2 and the wellhead casing (not shown). Below the casing hanger part 2*a* and outside the part 2*b* are the various parts of a locking assembly 4, 5 and 7 associated with a lower pack-off seal 6 which is disposed between the casing hanger 2 and the wellhead casing (not shown).

Below the lower pack-off seal 6, overlapping the lower part thereof and disposed outside the lower part 2*b* of the casing hanger 2, is a (relatively) outer casing 8, sometimes called the 13⅜" or 14" (356 mm) casing. The lower pack-off seal 6 engages the exterior of this casing.

The design of the locking assembly is not directly relevant to the invention but in this example it comprises an upper activator ring 4, an outer ring 5 making a threaded engagement with the lower pack-off seal 6; and a lower activator ring 7. The lower activator ring 7 is secured to the upper activator ring 4 by screws (not shown). The lower activator ring has a slot 71 which is opposite a groove 72 in the outer ring 5. Within the slot 71 in the ring 7 is a holder 73 which supports a shear pin 74 biased outwardly by a spring 75. The holder 73 is held in place by a screwed retainer ring 76. During the setting of the lower pack-off seal 6 the activator rings 4 and 7 move downwards; the spring loaded shear pin 74 engages the groove 72. There would normally be a plurality of such assemblies but only a single one is shown.

Between the outer casing 8 and the lower part of a production casing string, sometimes called the 9⅝" or 10" (254 mm) casing, which is not shown in the FIGURE but will be supported by and within the casing hanger 2, is an annular space, which is usually called the B annulus and is denoted by the letter B.

Within the upper part 2*a* of the casing hanger 2 is shown the lower part of a secondary isolation sleeve 9*a* for a production tree. The lowermost part of the isolation sleeve 9*a* fits within the part 2*b* of the casing hanger 2 and can be sealed relative thereto by a seal 10, which is held in place by a threaded ring 11 at the lower margin of the sleeve 9*a*, and a seal 12 which is disposed in an annular groove in the outer surface of the sleeve 9*a* just above the seal 10.

A primary isolation sleeve 9*b* fits within the upper part 2*a* of the casing hanger 2 and is sealed thereto by annular seals 13 and 14 each disposed in annular grooves in the periphery of the isolation sleeve 9*b*.

The secondary isolation sleeve 9*a* provides a vertical passageway 15 which leads upwards from a space 16 which is defined by the isolation sleeves 9*a* and 9*b* and the casing hanger 2 and in particular is below the primary isolation sleeve 9*b* and between the secondary isolation sleeve 9*a* and the casing hanger 2. This passageway 15 leads upwards to pressure monitoring devices which may be disposed in any convenient manner in the production tree and which can monitor the pressure in the annular space B. However, other arrangements may be used to provide communication between the space 16 and the production tree.

Within the lower part 2*b* of the casing hanger 2 is shown a generally cylindrical adaptor sleeve 17 which on its lower part has a screw threading 18 engageable with a screw-threading 19 on the inside of the lower part 2*b* of the casing hanger 2. There is a gap A between the top of the adaptor sleeve 17 and the bottom of the secondary isolation sleeve 9*a* to allow for the vertical movement of the adaptor sleeve 17 when it is rotated in screw-threaded engagement with the casing hanger.

The arrows in the FIGURE show the flow of fluid under pressure from the B annulus through a series of passageways provided by the casing hanger 2 to the passageway 15 which is between the primary isolation sleeve 9*b* and the secondary isolation sleeve 9*a* and which in this example leads to the production tree. This series of passageways comprises a passageway 20 between the casing 8 and the casing hanger 2, a radial passageway 21 through the part 2*b* of the casing hanger to the interior, a space 22 between the exterior of the adaptor 17 and the inside of the casing hanger 2, another radial passageway 23 partly through the casing hanger from the space 22, and a vertical passageway 24 which extends upwardly within the body of the casing hanger 2 to the space 16 between the casing hanger 2 and the isolation sleeves 9*a* and 9*b*. Thereby there is communication with the passageway 15.

The radial passageways 21 and 23 are spaced apart where they communicate with the interior of the casing hanger 2. The adaptor sleeve 17 carries exterior annular seals 25, 26 and 27, of which seal 25 is normally always above the passageway 21. The seals 26 and 27 may be disposed, according to the vertical position of the adaptor 17, either one above and one below the passageway 23 or both below the passageway 23.

For a position of the adaptor when the seals 26 and 27 straddle the passage 23, the passage of fluid from the B annulus to the passageway 15 is blocked, because fluid will not enter the passageway 23 from the space 22. For a position of the adaptor 17 as is shown in the FIGURE, the series of passageways between the annulus B and the passageway 15 is open. The space 22 embracing the locations where passageways 21 and 23 communicate with the interior of the casing hanger is however sealed from above and below by at least the seals 25 and 27 to prevent leakage upwards or downwards from or into the space 22.

It may be noted that the adaptor 17 may be operated by a simple mechanical spring-loaded key tool (not shown), which is required only to rotate the adaptor. Such a tool may readily be configured to operate through the Xmas tree after the tree has been landed and tested, so as to permit the testing of the adaptor and the communication interface before the installation of the blow-out preventer (BOP) and the completion string.

The invention claimed is:

1. A subsea wellhead assembly comprising:

a production casing hanger defining a series of passageways from an annulus between a production casing string and a relatively outer casing to an interior of said casing hanger and from an interior of said casing hanger through said casing hanger to a region communicable with a production tree, the passageways extending to the interior of the casing hanger, and a positionally adjustable sleeve which fits within the casing hanger and carries exterior seals which are disposed so that for a first position of the sleeve within the casing hanger, fluid passage through the series of passageways by way of said interior is blocked, and for a second position of the sleeve within the casing hanger, said fluid passage is allowed, wherein the sleeve makes screw-threaded engagement with the casing hanger such that movement of the sleeve between said positions can be effected by rotation of the sleeve.

2. An assembly according to claim 1 wherein said passageways include two passageways which communicate with the interior of the casing hanger in spaced apart locations and said seals comprise two spaced apart seals which in said first position of said sleeve are disposed one above and one below one of said two passageways.

3. An assembly according to claim 1 further comprising an isolation sleeve which provides communication between said region and a production tree.

4. An assembly according to claim 3 wherein said isolation sleeve defines an upward passageway from said region.

5. A subsea wellhead assembly comprising:

a production casing hanger defining a series of passageways from an annulus between a production casing string and a relatively outer casing to an interior of said casing hanger and from an interior of said casing hanger through said casing hanger to a region communicable with a production tree, the passageways extending to the interior of the casing hanger, and a positionally adjustable sleeve which fits within the casing hanger and carries exterior seals which are disposed so that for a first position of the sleeve within the casing hanger, fluid passage through the series of passageways by way of said interior is blocked, and for a second position of the sleeve within the casing hanger, said fluid passage is allowed, wherein said passageways include two passageways which communicate with the interior of the casing hanger in spaced apart locations and said seals comprise two spaced apart seals which in said first position of said sleeve are disposed one above and one below one of said two passageways, and wherein said seals include a third seal, the third seal and at least one of said two seals sealing a space embracing said locations from above and below.

6. A subsea wellhead assembly comprising:

a production casing hanger defining a series of passageways from an annulus between a production casing string and a relatively outer casing to an interior of said casing hanger and from an interior of said casing hanger through said casing hanger to a region communicable with a production tree, the passageways extending to the interior of the casing hanger, and a positionally adjustable sleeve which fits within the casing hanger and carries exterior seals which are disposed so that for a first position of the sleeve within the casing hanger, fluid passage through the series of passageways by way of said interior is blocked, and for a second position of the sleeve within the casing hanger, said fluid passage is allowed, wherein said passageways include two passageways which communicate with the interior of the casing hanger in spaced apart locations and said seals comprise two spaced apart seals which in said first position of said sleeve are disposed one above and one below one of said two passageways, and wherein one of the said two passageways extends radially through the casing hanger from the outside to the inside thereof and the other of said two passageways extends radially from the inside of the casing hanger partly through the casing hanger and extends upwardly through the body of the casing hanger to the region which can communicate with said production tree.

7. A production casing hanger for a subsea well, said production casing hanger comprising:

an upper cylindrical part and a lower cylindrical part of lesser internal diameter than the upper cylindrical part, wherein a first passageway extends radially through said lower part of the casing hanger from the outside to the inside thereof and a second passageway extends radially from the inside of the casing hanger partly through the casing hanger, and wherein a passageway extends upwardly from said second passageway through the lower part of the casing hanger to a region within the upper part of the casing hanger, said casing hanger being adapted to receive an internal sleeve which is positionally adjustable to allow and prevent fluid flow through the second passageway.

8. A production casing hanger according to claim 7 wherein the casing hanger has an internal screw-threading for engagement by the sleeve and allowing positional adjustment thereof.

9. A subsea wellhead assembly comprising:

a production casing hanger comprising a body defining a first passageway extending from an annulus between a production casing string and a relatively outer casing to the interior of the casing hanger and a second passageway extending from the interior of the casing hanger upwardly within the casing hanger to a region communicable with a production tree, and a positionally adjustable sleeve which fits within the casing hanger and carries seals which are disposed for selectively allowing and preventing communication between said first and second passageways according to the position of the sleeve, wherein the sleeve makes screw-threaded engagement with the casing hanger whereby said selectively allowing and preventing communication between said first and second passageways can be can be effected by rotation of the sleeve.

10. The assembly of claim 9 wherein said first and second passageways communicate with the interior of the casing hanger at spaced apart locations and said seals include two spaced apart seals which in a first position of said sleeve are disposed one above and one below one of said locations.

11. The assembly of claim 9 further comprising:

an isolation sleeve for providing communication between said region and a production tree.

12. The assembly of claim 11 wherein said isolation sleeve defines an upward passageway from said region.

13. A subsea wellhead assembly comprising:

a production casing hanger comprising a body defining a first passageway extending from an annulus between a production casing string and a relatively outer casing to the interior of the casing hanger and a second passageway extending from the interior of the casing hanger upwardly within the casing hanger to a region communicable with a production tree, and a positionally adjustable sleeve which fits within the casing hanger and carries seals which are disposed for selectively allowing and preventing communication between said first and second passageways according to the position of the sleeve, wherein said casing hanger comprises an upper part and a lower part of lesser internal diameter than said upper part, said first passageway extending through said lower part of the casing hanger from the outside to the inside thereof and said second passageway extending from the inside of the casing hanger extending and upwardly through said lower part of the casing hanger and through said upper part of the casing hanger to said region.

14. A subsea wellhead assembly comprising:

a production casing hanger comprising a body defining a first passageway extending from an annulus between a production casing string and a relatively outer casing to the interior of the casing hanger and a second passageway extending from said interior of the casing hanger upwardly within the casing hanger to a region communicable with a production tree;

an adjustable sleeve which fits within said casing hanger and is positionally adjustable relative to said casing hanger, said adjustable sleeve selectively allowing and preventing communication between said first and second passageways according to the position of the sleeve; and an isolation sleeve fitting within said casing hanger and sealed thereto below said region, said region being between said isolation sleeve and said casing hanger.

15. The assembly of claim 14 wherein said first and second passageways communicate with the interior of the casing hanger at spaced apart locations and said adjustable sleeve carries two seals which embrace said first and second locations and a third seal which in one position of said adjustable sleeve is disposed between said first and second locations.

16. The assembly of claim 14 wherein said adjustable sleeve makes screw-threaded engagement with said casing hanger whereby said selectively allowing and preventing communication between said first and second passageways is effected by rotation of said adjustable sleeve.

* * * * *